US005326462A

United States Patent [19]

Shih et al.

[11] Patent Number: 5,326,462

[45] Date of Patent: Jul. 5, 1994

[54] GASOLINE UPGRADING PROCESS

[75] Inventors: Stuart S-S. Shih, Cherry Hill, N.J.; Kathleen M. Keville, Beaumont, Tex.; Daria N. Lissy, Glen Mills, Pa.

[73] Assignee: Mobil Oil Corporation, Fairfax, Va.

[21] Appl. No.: 929,543

[22] Filed: Aug. 13, 1992

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[5] ..... C10G 45/00

[52] U.S. Cl. ..... 208/89; 208/58; 208/88; 208/212

[58] Field of Search ..... 208/70, 135, 60, 58, 208/89, 212

[56] References Cited

U.S. PATENT DOCUMENTS 4,016,245 4/1977 Plank et al. ..... 423/328
4,076,842 2/1978 Plank et al. ..... 423/328
4,556,477 12/1985 Dwyer ..... 208/111
4,753,720 6/1988 Morrison ..... 208/135
4,827,076 5/1989 Kakayeff et al. ..... 208/212

*Primary Examiner*—Helane Myers
*Attorney, Agent, or Firm*—Alexander J. McKillop; Dennis P. Santini; Laurence P. Hobbes

[57] ABSTRACT

Low sulfur gasoline of relatively high octane number is produced from a catalytically cracked, sulfur-containing naphtha by hydrodesulfurization followed by treatment over an acidic catalyst system comprising a zeolite having the topology of ZSM-5 and a zeolite sorbing 10 to 40 mg 3-methylpentane at 90° C., 90 torr, per gram dry zeolite in the hydrogen form, e.g., ZSM-22, ZSM-23, or ZSM-35. The treatment over the acidic catalyst system in the second step restores the octane loss which takes place as a result of the hydrogenative treatment and results in a low sulfur gasoline product with an octane number comparable to that of the feed naphtha.

17 Claims, No Drawings

GASOLINE UPGRADING PROCESS

CROSS REFERENCE TO RELATED APPLICATIONS

This application is a continuation-in-part of our prior application Ser. No. 07/850,106, filed Mar. 12, 1992 pending, which is a continuation-in-part of our prior application Ser. No. 07/745,311, filed 15 Aug. 1991 pending, the contents of both being incorporated herein by reference.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Heavy petroleum fractions, such as vacuum gas oil, or even resids such as atmospheric resid, may be catalytically cracked to lighter and more valuable products, especially gasoline. Catalytically cracked gasoline forms a major part of the gasoline product pool in the United States. It is conventional to recover the product of catalytic cracking and to fractionate the cracking products into various fractions such as light gases; naphtha, including light and heavy gasoline; distillate fractions, such as heating oil and Diesel fuel; lube oil base fractions; and heavier fractions.

Where the petroleum fraction being catalytically cracked contains sulfur, the products of catalytic cracking usually contain sulfur impurities which normally require removal, usually by hydrotreating, in order to comply with the relevant product specifications. These specifications are expected to become more stringent in the future, possibly permitting no more than about 300 ppmw sulfur in motor gasolines. In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina.

Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

In the hydrotreating of petroleum fractions, particularly naphthas, and most particularly heavy cracked gasoline, the molecules containing the sulfur atoms are mildly hydrocracked so as to release their sulfur, usually as hydrogen sulfide. After the hydrotreating operation is complete, the product may be fractionated, or even just flashed, to release the hydrogen sulfide and collect the now sweetened gasoline. Although this is an effective process that has been practiced on gasolines and heavier petroleum fractions for many years to produce satisfactory products, it does have disadvantages.

Naphthas, including light and full range naphthas, may be subjected to catalytic reforming so as to increase their octane numbers by converting at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute substantial volume to the gasoline pool, but they do not generally contribute significantly to higher octane values without reforming.

Cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool. Therefore, it is a most desirable component of the gasoline pool, and it should not be lightly tampered with.

Other highly unsaturated fractions boiling in the gasoline boiling range, which are produced in some refineries or petrochemical plants, include pyrolysis gasoline. This is a fraction which is often produced as a by-product in the cracking of petroleum fractions to produce light unsaturates, such as ethylene and propylene. Pyrolysis gasoline has a very high octane number but is quite unstable in the absence of hydrotreating because, in addition to the desirable olefins boiling in the gasoline boiling range, it also contains a substantial proportion of diolefins, which tend to form gums after storage or standing.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Other processes for treating catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

SUMMARY OF THE INVENTION

We have now devised a process for catalytically desulfurizing cracked fractions in the gasoline boiling range which enables the sulfur to be reduced to acceptable levels without substantially reducing the octane number. In favorable cases, the volumetric yield of gasoline boiling range product is not substantially reduced and may even be increased so that the number of octane barrels of product produced is at least equivalent to the number of octane barrels of feed introduced into the operation.

The process may be utilized to desulfurize light and full range naphtha fractions while maintaining octane so as to obviate the need for reforming such fractions, or at least, without the necessity of reforming such fractions to the degree previously considered necessary. Since reforming generally implies a significant yield loss, this constitutes a marked advantage of the present process.

The process of the invention is based upon a catalyst system which contains at least two components in which each component contributes a performance advantage to the process. A component which contributes a substantial octane increase is combined with another component which causes reduced olefin and alkyl benzene make while also contributing to octane rating.

According to the present invention, a sulfur-containing cracked petroleum fraction in the gasoline boiling range is hydrotreated, in a first stage, under conditions which remove at least a substantial proportion of the sulfur. Hydrotreated intermediate product is then treated, in a second stage, by contact with a catalyst system of acidic functionality comprising a zeolite having the topology of ZSM-5 and a zeolite of constrained intermediate pore size capable of sorbing 10 to 40 mg 3-methylpentane at 90° C, 90 torr 3-methylpentane, per gram dry zeolite in the hydrogen form, under conditions which convert the hydrotreated intermediate product fraction to a fraction in the gasoline boiling range of higher octane value.

The invention is directed to a process for upgrading a sulfur-containing feed fraction boiling in the gasoline boiling range which comprises:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst system of acidic functionality which comprises a zeolite having the topology of ZSM-5 and a zeolite of constrained intermediate pore size capable of sorbing 10 to 40 mg 3-methylpentane at 90° C., 90 torr 3-methylpentane, per gram dry zeolite in the hydrogen form, under conditions which convert it to a product comprising a fraction boiling in the gasoline boiling range having a higher octane number than the gasoline boiling range fraction of the intermediate product.

The use of the catalyst composition of this invention will result in improved octane numbers in the gasoline product and improved gasoline yields, due to enhanced shape-selective reactions, e.g., cracking, relative to ZSM-5 alone or constrained intermediate pore zeolite alone in a single zeolite catalyst system.

DETAILED DESCRIPTION OF THE INVENTION

Feed

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. The most preferred feed for the combined zeolite catalyst system of the present invention appears at this time to be a full range feed or lighter cut (260° F. to 412° F.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F.(150° C.) will be suitable. The exact cut point selected will depend on the sulfur specification for the gasoline product as well a on the type of sulfur compounds present: lower cut points will typically be necessary for lower product sulfur specifications. Sulfur which is present in components boiling below about 150° F.(65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F.(82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

This hydrotreated intermediate product which also boils in the gasoline boiling range (and usually has a boiling range which is not substantially higher than the boiling range of the feed), is then treated by contact with an acidic catalyst under conditions which produce a second product comprising a fraction which boils in the gasoline boiling range which has a higher octane number than the portion of the hydrotreated intermediate product fed to this second step. The product from this second step usually has a boiling range which is not substantially higher than the boiling range of the feed to the hydrotreater, but it is of lower sulfur content while having a comparable octane rating as the result of the second stage treatment.

The catalyst used in the second stage of the process has a significant degree of acid activity, and for this purpose the most preferred materials are the crystalline refractory solids having a constrained intermediate effective pore size and the topology of a zeolitic behaving material.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation.

Octane Restoration—Second Step Processing

After the hydrotreating step, the hydrotreated intermediate product is passed to the second step of the process in which cracking takes place in the presence of the acidic functioning catalyst system. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

The separation of the light ends at this point may be desirable if the added complication is acceptable since the saturated $C_4$–$C_6$ fraction from the hydrotreater is a highly suitable feed to be sent to the isomerizer for conversion to iso-paraffinic materials of high octane rating; this will avoid the conversion of this fraction to non-gasoline ($C_5-$) products in the second stage of the process. Another process configuration with potential advantages is to take a heart cut, for example, a 195°–302° F. (90°–150° C.) fraction, from the first stage product and send it to the reformer where the low octane naphthenes which make up a significant portion of this fraction are converted to high octane aromatics. The heavy portion of the first stage effluent is, however, sent to the second step for restoration of lost octane by treatment with the acid catalyst. The hydrotreatment in the first stage is effective to desulfurize and denitrogenate the catalytically cracked naphtha which permits the heart cut to be processed in the reformer. Thus, the preferred configuration in this alternative is for the second stage to process the $C_8+$ portion of the first stage effluent and with feeds which contain significant amounts of heavy components up to about $C_{13}$ e.g. with $C_9$–$C_{13}$ fractions going to the second stage, improvements in both octane and yield can be expected.

The conditions used in the second step of the process are those which result in a controlled degree of shape-selective cracking of the desulfurized, hydrotreated effluent from the first step to produce higher octane components such as olefins, branched paraffins and aromatics which restore the octane rating of the original, cracked feed at least to a partial degree. The reactions which take place during the second step are mainly the shape-selective cracking of low octane paraffins to form higher octane products, both by the selective cracking of heavy paraffins to lighter paraffins and the cracking of low octane n-paraffins, in both cases with the generation of olefins. An increase in volume is typical for the second step of the process where, as the result of cracking the back end of the hydrotreated feed, cracking products within the gasoline boiling range are produced. An overall increase in volume of the gasoline boiling range ($C_5+$) materials may occur. Generally, the constrained intermediate pore zeolites employed herein provide a greater volume of gasoline boiling range materials than less constrained zeolites such as ZSM-5. Constrained imtermediate pore zeolites are more selective for n-paraffin cracking owing to their reduced cracking rates for branched paraffins. Such zeolites provide higher gasoline yields as well as enhanced octane enhancement.

In the second step, some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating×volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5-$) during the second stage is held to a minimum. However, because the cracking of the heavier portions of the feed may lead to the production of products still within the gasoline range, no net conversion to $C_5-$ products may take place and, in fact, a net increase in $C_5+$ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

Second Step Catalyst

The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The acidic catalyst system is comprised of a combination of crystalline molecular sieve having the topology of ZSM-5 and a constrained intermediate pore zeolite. ZSM-5 is described in U.S. Pat. No. 3,702,886, and reference should be made thereto for a complete description.

The constrained intermediate pore size zeolites are capable of sorbing in their intracrystalline voids 10 mg to 40 mg 3-methylpentane at 90° C., 90 torr 3-methylpentane, per gram dry zeolite in the hydrogen form. These materials, exemplified by ZSM-22, ZSM-23, and ZSM-35, are members of a unique class. They have channels described by 10-membered rings of T (=Si or Al) or oxygen atoms, i.e., they are intermediate pore zeolites, distinct from small pore 8-ring or large pore 12-ring zeolites. They differ, however, from other intermediate pore 10-ring zeolites, such as ZSM-5, ZSM-11, ZSM-57 or stilbite, in having a smaller 10-ring channel. If the crystal structure (and hence pore system) is known, a convenient measure of the channel cross-section is given by the product of the dimensions (in angstrom units) of the two major axes of the pores. These dimensions are listed in the "Atlas of Zeolite Structure Types" by W. M. Meier and D. H. Olson, Butterworths, publisher, Second Edition, 1987. The values of this product, termed the Pore Size Index, are listed below in Table A.

TABLE A

| Type | Largest Ring Size | Zeolite | Pore Size Index: Axes of Largest Channel, A | Pore Size Index: Pore Size Index |
|---|---|---|---|---|
| 1 | 8 | Chabazite | 3.8 × 3.8 | 14.4 |

TABLE A-continued

| Type | Largest Ring Size | Zeolite | Pore Size Index: Axes of Largest Channel, A | Pore Size Index: Pore Size Index |
|---|---|---|---|---|
| | | Erionite | 3.6 × 5.1 | 18.4 |
| | | Linde A | 4.1 × 4.1 | 16.8 |
| 2 | 10 | ZSM-22 | 4.4 × 5.5 | 24.2 |
| | | ZSM-23 | 4.5 × 5.2 | 23.4 |
| | | ZSM-35 | 4.2 × 5.4 | 22.7 |
| | | ALPO-11 | 3.9 × 6.3 | 24.6 |
| 3 | 10 | ZSM-5 | 5.3 × 5.6 | 29.1 |
| | | ZSM-11 | 5.3 × 5.4 | 28.6 |
| | | Stilbite | 4.9 × 6.1 | 29.9 |
| | | ZSM-57 (10) | 5.1 × 5.8 | 29.6 |
| 4 | 12 | ZSM-12 | 5.5 × 5.9 | 32.4 |
| | | Mordenite | 6.5 × 7.0 | 45.5 |
| | | Beta (C-56) | 6.2 × 7.7 | 47.7 |
| | | Linde-L | 7.1 × 7.1 | 50.4 |
| | | Mazzite (ZSM-4) | 7.4 × 7.4 | 54.8 |
| | | $ALPO_4$-5 | 7.3 × 7.3 | 53.3 |

It can be seen that small pore, eight-ring zeolites have a Pore Size Index below about 20, the intermediate pore, 10-ring zeolites of about 20–31, and large pore, 12-ring zeolites above about 31. It is also apparent, that the 10-ring zeolites are grouped in two distinct classes; Type 2 with a Pore Size Index between about 22.7 and 24.6, and more broadly between about 20 and 26, and Type 3 with a Pore Size Index between 28.6 and 29.9, or more broadly, between about 28 and 31.

The zeolites which are suited for this invention are those of Type 2 with a Pore Size Index of 20–26.

The Type 2 zeolites are distinguished from the other types by their sorption characteristics towards 3-methylpentane. Representative equilibrium sorption data and experimental conditions are listed in Table B.

Type 2 zeolites sorb in their intracrystalline voids at least about 10 mg and no greater than about 40 mg of 3-methylpentane at 90° C., 90 torr 3-methylpentane, per gram dry zeolite in the hydrogen form. In contrast, Type 3 zeolites sorb greater than 40 mg 3-methylpentane under the conditions specified.

The equilibrium sorption are obtained most conveniently in a thermogravimetric balance by passing a stream of inert gas such as helium containing the hydrocarbon with the indicated partial pressure over the dried zeolite sample held at 90° C. for a time sufficient to obtain a constant weight.

Samples containing cations such as sodium or aluminum ions can be converted to the hydrogen form by well-known methods such as exchange at temperatures between 25° and 100° C. with dilute mineral acids, or with hot ammonium chloride solutions followed by calcination. For mixtures of zeolites with amorphous material or for poorly crystallized samples, the sorption values apply only to the crystalline portion.

This method of characterizing the Type 2 zeolites has the advantage that it can be applied to new zeolites whose crystal structure has not yet been determined.

TABLE B

| Type | Zeolite | Equilibrium Sorption Data of Medium Pore Zeolites: Amount sorbed, mg per g zeolite 3-Methylpentane[a)] |
|---|---|---|
| 2 | ZSM-22 | 20 |
| | ZSM-23 | 25 |
| | ZSM-35 | 25 |
| 3 | ZSM-5 | 61 |
| | ZSM-12 | 58 |
| | ZSM-57 | 70 |

TABLE B-continued

| Equilibrium Sorption Data of Medium Pore Zeolites | | |
|---|---|---|
| Type | Zeolite | Amount sorbed, mg per g zeolite 3-Methylpentane[a)] |
| | MCM-22 | 79 |

[a)] at 90° C., 90 torr 3-methylpentane

ZSM-22 is more particularly described in U.S. Pat. No. 4,556,477, the entire contents of which are incorporated herein by reference. ZSM-22 and its preparation in microcrystalline form using ethylpyridinium as directing agent is described in U.S. Pat. No. 4,481,177 to Valyocsik, the entire contents of which are incorporated herein by reference. For purposes of the present invention, ZSM-22 is considered to include its isotypes, e.g., Theta-1, Gallo-Theta-1, NU-10, ISI-1, and KZ-2.

ZSM-23 is more particularly described in U.S. Pat. No. 4,076,842, the entire contents of which are incorporated herein by reference. For purposes of the present invention, ZSM-23 is considered to include its isotypes, e.g., EU-13, ISI-4, and KZ-1.

ZSM-35 is more particularly described in U.S. Pat. No. 4,016,245, the entire contents of which are incorporated herein by reference. Isotypes of ZSM-35 include ferrierite (P.A. Vaughan, Acta Cryst. 21, 983 (1966)); FU-9 (D. Seddon and T. V. Whittam, European Patent B-55,529, 1985); ISI-6 (N. Morimoto, K. Takatsu and M. Sugimoto, U.S. Pat. No. 4,578,259, 1986); monoclinic ferrierite (R. Gramlich-Meier, V. Gramlich and W. M. Meier, Am. Mineral. 70, 619 (1985)); NU-23 (T. V. Whittam, European Patent A-103,981, 1984); and Sr-D (R. M. Barrer and D. J. Marshall, J. Chem. Soc. 1964, 2296 (1964)). An example of a piperidine-derived ferrierite is more particularly described in U.S. Pat. No. 4,343,692, the entire contents of which are incorporated herein by reference. Other synthetic ferrierite preparations are described in U.S. Pat. Nos. 3,933,974; 3,966,883; 4,000,248; 4,017,590; and 4,251,499, the entire contents of all being incorporated herein by reference. Further descriptions of ferrierite are found in Bibby et al, "Composition and Catalytic Properties of Synthetic Ferrierite," Journal of Catalysis, 35, pages 256–272 (1974).

The ZSM-5 and constrained intermediate pore zeolite used in the catalyst system are preferably at least partly in the hydrogen form, e.g., HZSM-5, and HZSM-22, HZSM-23, or HZSM-35. The hydrogen form provides the desired acidic functionality for the cracking reactions which are to take place. As stated below, the zeolite's acidic functionality can be characterized by the alpha value. The acidic functionality may be controlled by base exchange of the zeolite, especially with alkali metal cations, such as sodium, by steaming or by control of the silica-to-alumina mole ratio of the zeolite. Other metals or cations thereof, e.g. rare earth cations, may also be present. When the zeolites are prepared in the presence of organic cations, they may be quite inactive possibly because the intracrystalline free space is occupied by the organic cations from the forming solution. The zeolites may be activated by heating in an inert or oxidative atmosphere to remove the organic cations, e.g. by heating at over 500° C. for 1 hour or more. Other cations, e.g. metal cations, can be introduced by conventional base exchange or impregnation techniques.

These materials are exemplary of the topology and pore structure of suitable acid-acting refractory solids. A useful catalyst system is not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The catalyst used in the second step of the process possesses sufficient acidic functionality to bring about the desired cracking reactions to restore the octane lost in the hydrotreating step. One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant $=0.016$ sec $^{-1}$). The alpha test is described in U.S. Pat. No. 3,354,078 and in *J. Catalysis*, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis*, 61, 395 (1980).

The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

Typical ion exchange techniques comprise contacting the zeolite with a salt of the desired replacing cation or cations. Although a wide variety of salts can be employed, particular preference is given to chlorides, nitrates and sulfates.

Prior to use, the zeolites should be dehydrated at least partially. This can be done by heating to a temperature in the range of 440° F. to 1100° F. in an air or an inert atmosphere, such as nitrogen for 1 to 48 hours. Dehydration can also be performed at lower temperatures by using a vacuum, but a longer time is required to obtain a sufficient amount of dehydration.

It is also possible to treat the zeolites with steam at elevated temperatures ranging from 800° F. to 1600° F. and treatment may be accomplished in atmospheres consisting partially or entirely of steam.

The zeolites are combined in the catalyst in amounts which may vary depending upon the preferred product composition. The ZSM-5 component facilitates production of high octane products while increasing conversion of higher boiling components relative to the other component. The constrained intermediate pore molecular sieve component preserves heavy aromatics and adds an extra boost in the octane without increasing olefin make. Thus, it is appropriate to vary the amount of each zeolite depending upon the preferred product composition; that is, if greater conversion is needed (a higher boiling point feed and lower cut point gasoline specifications), a higher proportion of ZSM-5 should be used. If reduced olefin content is desired, a higher proportion of constrained intermediate pore zeolite should be used. Furthermore, if lighter feeds will be processed, a higher proportion of constrained intermediate pore size zeolite should be used. For heavier feeds, the proportion of each zeolite can be present in the catalyst in about equal amounts in order to achieve a balance in the properties. In general, the catalyst system can contain a ratio of zeolite having the topology of ZSM-5 to constrained intermediate pore zeolite ranging from 1:19 to 19: 1, preferably ranging from 3:17 to 17:3 in parts by weight.

The catalyst system comprises a physical mixture of the zeolite components or a single particle catalyst with two zeolites in a binder. The catalyst composite can be prepared by mechanically mixing together the two zeolites to produce a catalyst composition which comprises a mixture of discrete crystallites of the zeolites, or zeolite behaving materials. The zeolites can be mixed and then a suitable hydrogenation-dehydrogenation component can be deposited on at least one of them by conventional impregnation techniques, either before, after or during mixing.

The active component of the catalyst system, e.g., the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina, titania, and zirconia.

Both zeolite components need not be mixed with the same matrix. Each can be incorporated into its own separate binder and the ZSM-5-containing composite material can be blended with constrained intermediate pore zeolite composite material. The catalyst composites can be used in a physical mixture in the bed or the catalyst bed can be made of layers of each catalyst composite.

Preferred catalysts include HZSM-5 or ZSM-5/$Al_2O_3$ (65/35 wt %) and H-ZSM-23; HZSM-5 or ZSM-5/$Al_2O_3$ (65/35 wt %) and H-ZSM-35; and HZSM-5 or ZSM-5/$Al_2O_3$ (65/35 wt %) and H-ZSM-22.

The octane efficiency of the process; that is, the octane gain relative to the yield loss will vary according to a number of factors, including the nature of the feedstock, the conversion level and the relative proportions and activities of the catalysts. It may be useful to vary the amount of each zeolite distributed throughout the bed. That is, it may be preferred to place more ZSM-5 towards the top of the bed for maximum conversion of the heavier hydrocarbons to lighter hydrocarbons which can be handled by the constrained intermediate pore catalyst located downstream. Alternatively, a multi-bed or 2-bed reactor may be employed in which the ZSM-5 is located entirely in the first bed and the constrained intermediate pore size zeolite is located downstream in a second bed. In this manner, optimum efficiency of the constrained intermediate pore zeolite for octane gain may be achieved.

The catalyst system used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions as well as possibly bringing about recombination of inorganic sulfur. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the second conversion catalyst will usually be determined by the type of conversion process which is being carried out, such as: a down-flow, liquid phase, fixed bed process; an upflow, fixed bed, liquid phase process; an ebullating, fixed fluidized bed liquid or gas phase process; or a liquid or gas phase, transport, fluidized bed process, as noted above, with the fixed-bed type of operation preferred.

PRODUCT OPTIMIZATION

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the second step of the process are particularly suitable for this purpose since they are more olefinic than the comparable but saturated fraction from the hydrotreating step. Alternatively, the olefinic light ends from the second step may be used as feed to an etherification process to produce ethers such as MTBE or TAME for use as oxygenate fuel components.

In one example of the operation of this process, it is reasonable to expect that, with a heavy cracked naphtha feed, the first stage hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the sulfur content is high in the feed, that this octane reduction could go as high as about 15%.

The second stage of the process should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

The following example demonstrates the expected advantages of the process. The Examples below illustrate the use of ZSM-5/ZSM-23 and ZSM-5/ZSM-35 in the second stage of the present process, together with the results from single zeolite ZSM-5, ZSM-22, and ZSM-23 catalysts for comparison. In these examples, parts and percentages are by weight unless they are expressly stated to be on some other basis. Temperatures are in °F. and pressures in psig, unless expressly stated to be on some other basis. In the following example, a heavy cracked naphtha containing sulfur, was subjected to processing under the conditions described below to allow a maximum of only 300 ppmw sulfur in the final gasoline boiling range product.

EXAMPLE

A cracked naphtha is processed in an isothermal pilot plant under the following conditions: pressure of 600 psig, space velocity of 1 LHSV, a hydrogen circulation rate of 3200 SCF/Bbl (4240 kPa abs, 1 hr.$^{-1}$ LHSV, 570 n.l.l$^{-1}$.). Experiments are run at reactor temperatures from 500° to 775° F. (about 260° to 415° C.). In all cases, the process is operated with two catalyst beds (HDS catalyst in the first bed, a ZSM-5 (Catalyst 1), ZSM-23 (Catalyst 2), ZSM-35 (Catalyst 3), ZSM-5/ZSM-23 (Catalyst 4) or ZSM-5/ZSM-35 (Catalyst 5), catalyst in the second bed) in a cascade mode with both catalyst bed/reaction zones operated at the same pressure and space velocity and with no intermediate separation of the intermediate product of the hydrodesulfurization.

TABLE C

| Bed Compositions | Catalyst 1 | Catalyst 2 | Catalyst 3 | Catalyst 4 | Catalyst 5 |
|---|---|---|---|---|---|
| HDS, vol %(1) | 50 | 50 | 50 | 50 | 50 |
| ZSM-5, vol %(2) | 50 | 0 | 0 | 25 | 25 |
| ZSM-23, vol %(2) | 0 | 50 | 0 | 25 | 0 |
| ZSM-35, vol %(2) | 0 | 0 | 50 | 0 | 25 |
| RXR Temp, °F. | 700 | 550 | 525 | 625 | 610 |
| $C_5$+ Gasoline Yield, vol % | 99.5 | 101.5 | 101.6 | 100.1 | 100.6 |
| $C_5$+ Product Octane, R+O | 95.7 | 95.3 | 95.5 | 95.5 | 95.6 |
| Useful Light Gas Yield, wt % | | | | | |
| $C_3$= | 0.22 | 0.05 | 0.15 | 0.09 | 0.15 |
| $C_4$= | 0.51 | 0.12 | 0.34 | 0.13 | 0.42 |
| $C_5$= | 0.47 | 0.09 | 0.18 | 0.31 | 0.38 |
| Branched $C_4$ | 1.0 | 0.22 | 0.15 | 0.35 | 0.74 |
| Branched $C_5$ | 0.86 | 0.27 | 0.19 | 0.18 | 0.49 |

(1) $CoMo/Al_2O_3$
(2) Contains 65% zeolite/35 wt % $Al_2O_3$

We claim:

1. A process of upgrading a sulfur-containing feed fraction boiling in the gasoline boiling range which comprises:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst system of acidic functionality comprising a zeolite having the topology of ZSM-5 and a constrained intermediate pore zeolite sorbing 10 to 40 mg 3-methylpentane at 90° C., 90 torr 3-methylpentane, per gram dry zeolite in the hydrogen form, to convert said portion to a product comprising a fraction boiling in the gasoline boiling range having a higher octane number than the gasoline boiling range fraction of the intermediate product.

2. The process as claimed in claim 1 in which the constrained intermediate pore zeolite is selected from the group consisting of ZSM-22, ZSM-23, and ZSM-35.

3. The process as claimed in claim 1 in which said feed fraction comprises a light naphtha fraction having a boiling range within the range of $C_6$ to 330 ° F. and said catalyst system contains a ratio of zeolite having the topology of ZSM-5 to constrained intermediate pore zeolite ranging from 1:19 to 19:1.

4. The process as claimed in claim 1 in which said feed fraction comprises a full range naphtha fraction having a boiling range within the range of $C_5$ to 420 ° F. and said catalyst system contains a ratio of zeolite having the topology of ZSM-5 to constrained intermediate pore zeolite ranging from 3:17 to 17:3.

5. The process as claimed in claim 1 in which said feed fraction comprises a full range naphtha fraction having a boiling range within the range of $C_5$ to 420° F.

6. The process as claimed in claim 1 in which said feed fraction comprises a naphtha fraction having a boiling range within the range of 260° to 412° F.

7. The process as claimed in claim 1 in which said feed is a cracked naphtha fraction comprising olefins.

8. The process as claimed in claim 1 in which the constrained intermediate pore zeolite has the topology of ZSM-22.

9. The process as claimed in claim 1 in which the constrained intermediate pore zeolite has the topology of ZSM-23.

10. The process as claimed in claim 1 in which the constrained intermediate pore zeolite has the topology of ZSM-23.

11. The process as claimed in claim 1 in which the constrained intermediate pore size zeolite and the zeolite having the topology of ZSM-5 are in the aluminosilicate form.

12. The process as claimed in claim 1 in which the acidic catalyst system includes a metal component having hydrogenation functionality.

13. The process as claimed in claim 1 which is carried out in two stages with an interstage separation of light ends and heavy ends with the heavy ends fed to the second reaction zone.

14. A process of upgrading a sulfur-containing feed fraction boiling in the gasoline boiling range which comprises:

hydrodesulfurizing a catalytically cracked, olefinic, sulfur-containing gasoline feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst system of acidic functionality comprising a zeolite having the topology of ZSM-5 and a zeolite sorbing 10 to 40 mg 3-methylpentane at 90° C., 90 torr, per gram dry zeolite in the hydrogen form, to convert it to a product comprising a fraction boiling in the gasoline boiling range having a higher octane number than the gasoline boiling range fraction of the intermediate product.

15. The process as claimed in claim 14 in which the catalyst system comprises a catalyst composite containing a mixture of discrete crystallites of a zeolite having the topology of ZSM-5 and a zeolite having the topology selected from ZSM-22, ZSM-23 and ZSM-35.

16. The process as claimed in claim 14 which is carried out in two stages with an interstage separation of light ends and heavy ends with the heavy ends fed to the second reaction zone.

17. The process as claimed in claim 14 which is carried out in cascade mode with the entire effluent from the first reaction passed to the second reaction zone.

* * * * *